US005951325A

United States Patent [19]

Tang et al.

[11] Patent Number: 5,951,325

[45] Date of Patent: Sep. 14, 1999

[54] BOARDLOCK AND ALIGNED POST OF HORIZONTAL CONNECTOR

[75] Inventors: Chiu-Yu Tang, San Jose; Lee-Ming Cheng, Cupertino, both of Calif.

[73] Assignee: Hon Hai Precision Ind. Co., Ltd., Taipei Hsien, Taiwan

[21] Appl. No.: 08/865,686

[22] Filed: May 30, 1997

[51] Int. Cl.[6] ..... H01R 13/73

[52] U.S. Cl. ..... 439/567

[58] Field of Search ..... 439/567, 571–573, 439/569, 570

[56] References Cited

U.S. PATENT DOCUMENTS 5,178,557 1/1993 Hashiguchi ..... 439/570
5,238,413 8/1993 McCaffrey et al. ..... 439/571
5,257,948 11/1993 Peterson ..... 439/571

*Primary Examiner*—Gary Paumen

[57] ABSTRACT

An electrical connector (10) includes an insulative housing (12) with a plurality of contacts. Adjacent either end of the housing (12) a boardlock (20) and a post (40) are arranged to be aligned with each other in a front-to-end direction. The boardlock (20) generally includes a first vertical section (22) for engagement with the corresponding grounding tang of a complementary connector, and a second vertical section (24) with the downward extending retention legs (25) for extending through a first corresponding hole (102) in the PC board (100), and an upward guiding tab (26). The post (40) includes a horizontal section (42) for retaining the post (40) within the housing (12), and a vertical lug section (46) for extending through a second corresponding hole (104) in the PC board (100).

3 Claims, 7 Drawing Sheets

BOARDLOCK AND ALIGNED POST OF HORIZONTAL CONNECTOR

BACKGROUND OF THE INVENTION

1. Field of the Invention

The invention relates to an electrical connector, and particularly to a connector having a boardlock and a post aligned with each other in a front-to-back direction for mounting to a PC board on which the connector is seated.

2. The Related Art

Generally speaking, for mounting a connector to a PC board, the electrical connector has either boardlocks or posts for temporary retention, i.e., before contact tails are soldered to the PC board, or permanent engagement of the connector to the PC board. The conventional post is integrally formed with the housing, e.g., the plastic post extends from the bottom surface of the plastic housing, while the conventional boardlock is made of metal which is adapted to be inserted into the housing of the connector. Usually, boardlocks and posts are not used together with the same connector. However, some connectors use both boardlocks and posts for achieving better installation and stability of the connector on the PC board. Due to limitations of the circuit board layout, the post and the metal boardlock should sometimes be arranged in alignment with each other in the front-to-back direction. In this situation, conventional assembly of the boardlock to the housing from the back is not easy because the integral post may obstruct forward installation of the boardlock.

A metal post can be used in the connector instead of the conventional post which is integrally formed with the plastic housing. The metal post may be integrally formed with the metal boardlock or as separate components aligned with each other in a front-to-back direction. If the boardlock and the post are integrally formed with each other, both risk becoming displaced if one of them is deformed. Therefore, an object of the invention is to provide an electrical connector with separate posts and boardlocks wherein the post is generally aligned with the boardlock in the front-to-back direction.

SUMMARY OF THE INVENTION

According to an aspect of the invention, an electrical connector includes an insulative housing with a plurality of contacts. Adjacent to either end of the housing, a boardlock and a post are arranged in alignment with each other in a front-to-back direction. The boardlock generally includes a first vertical section for engagement with a corresponding grounding tang of a complementary connector, and a second vertical section with downward extending retention legs for extending through a first corresponding hole in the PC board, and an upward guiding tab. The post includes a horizontal section for retaining the post within the housing, and a vertical lug section for extending through a second corresponding hole in the PC board.

BRIEF DESCRIPTION THE DRAWINGS

DETAILED DESCRIPTION OF THE PREFERRED EMBODIMENTS

Figure 1:
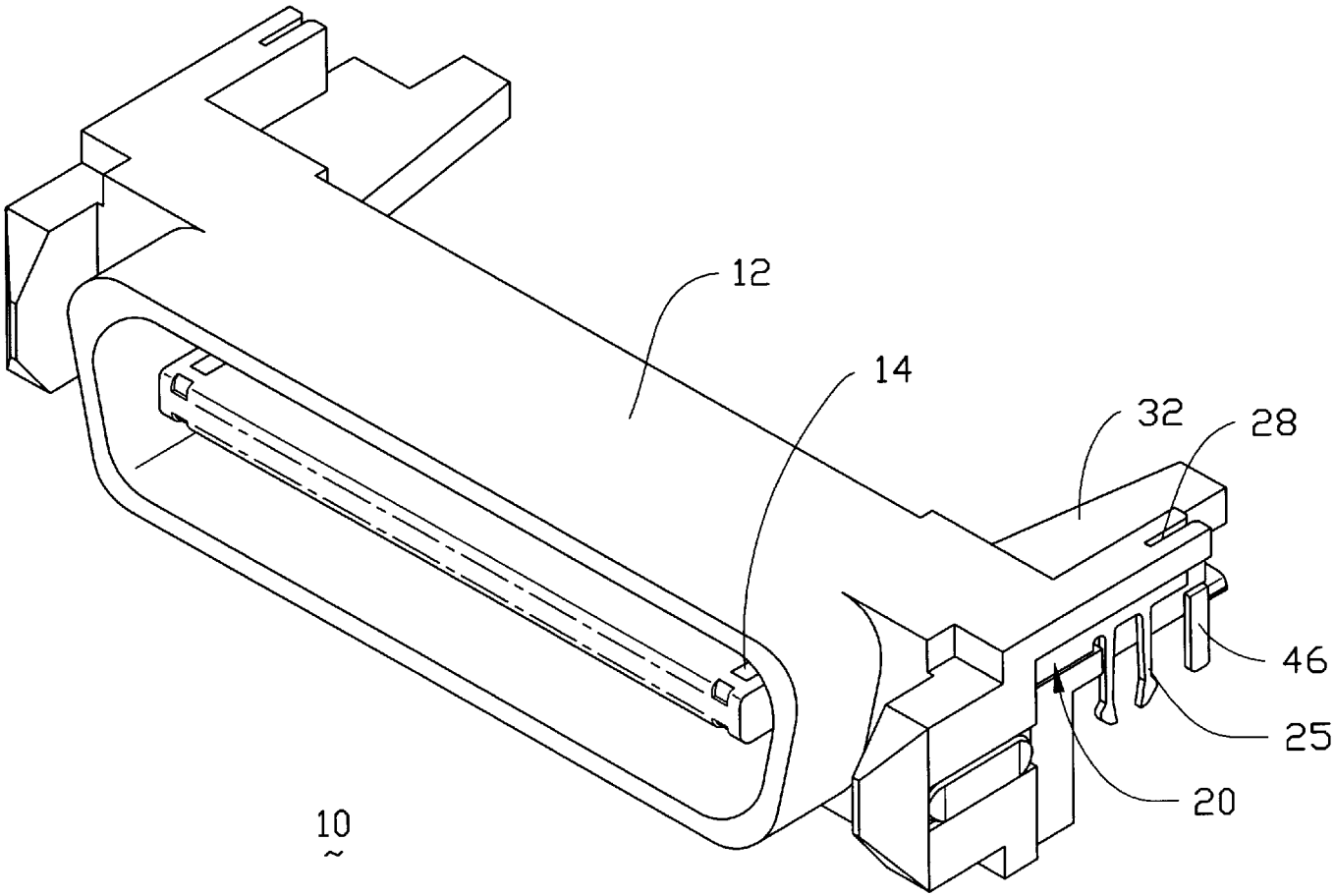
FIG. 1 is a front perspective view of a preferred embodiment of an electrical connector in accordance with the invention.
Figure 2:
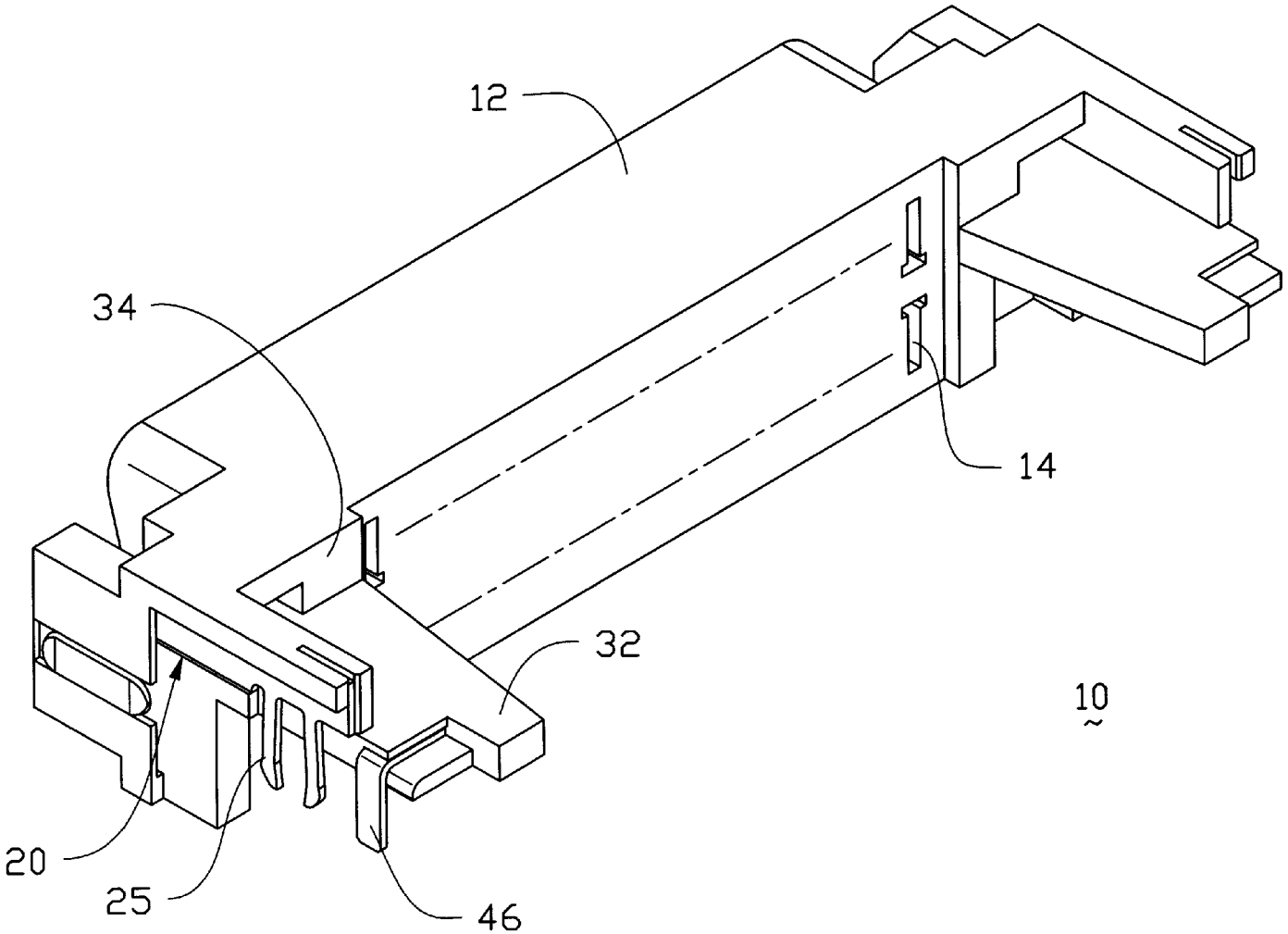
FIG. 2 is a rear perspective view of the connector of FIG. 1.
Figure 3:
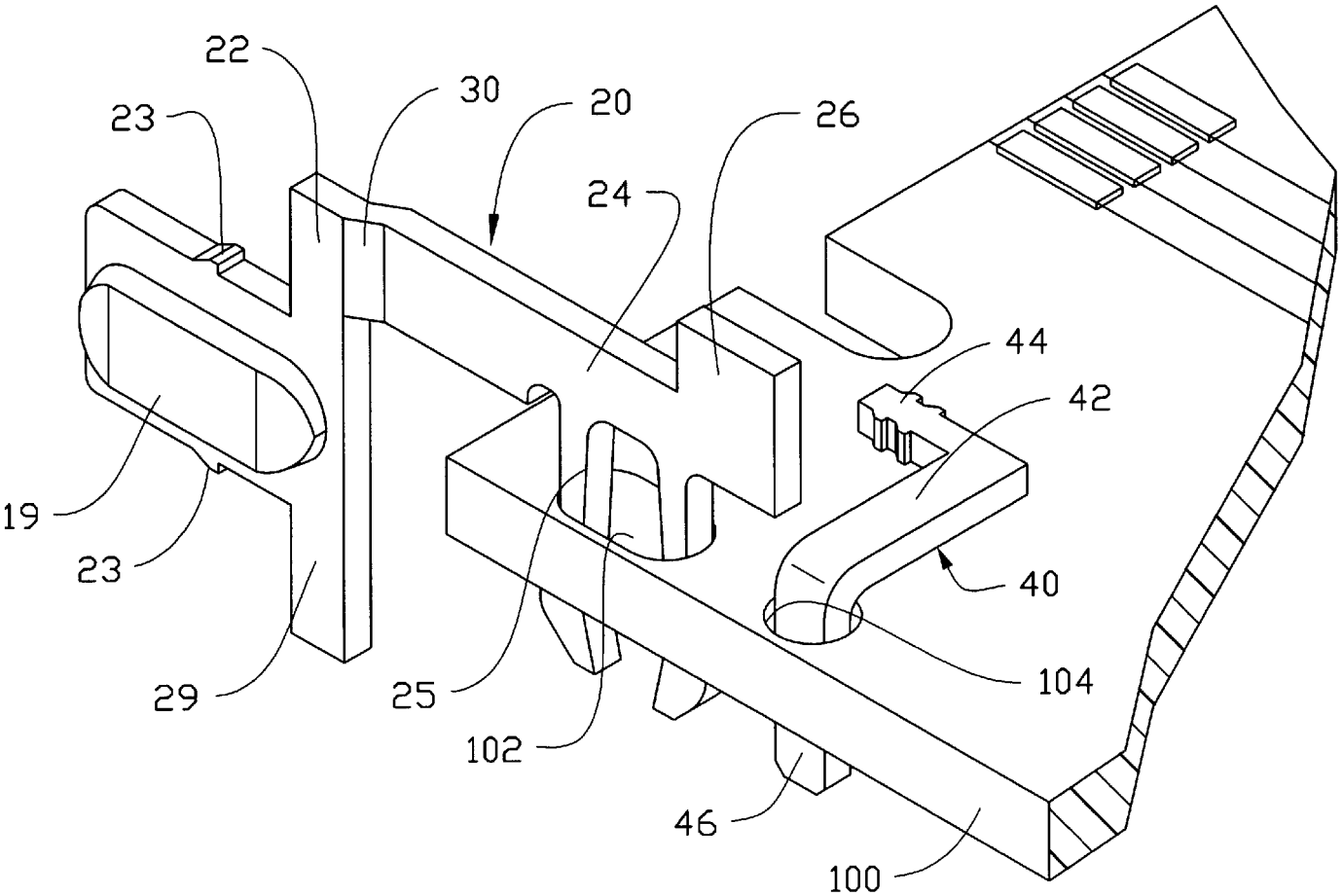
FIG. 3 is a perspective view of the boardlock and the post of FIG. 1 with the PC board on which the connector is seated.
Figure 4:
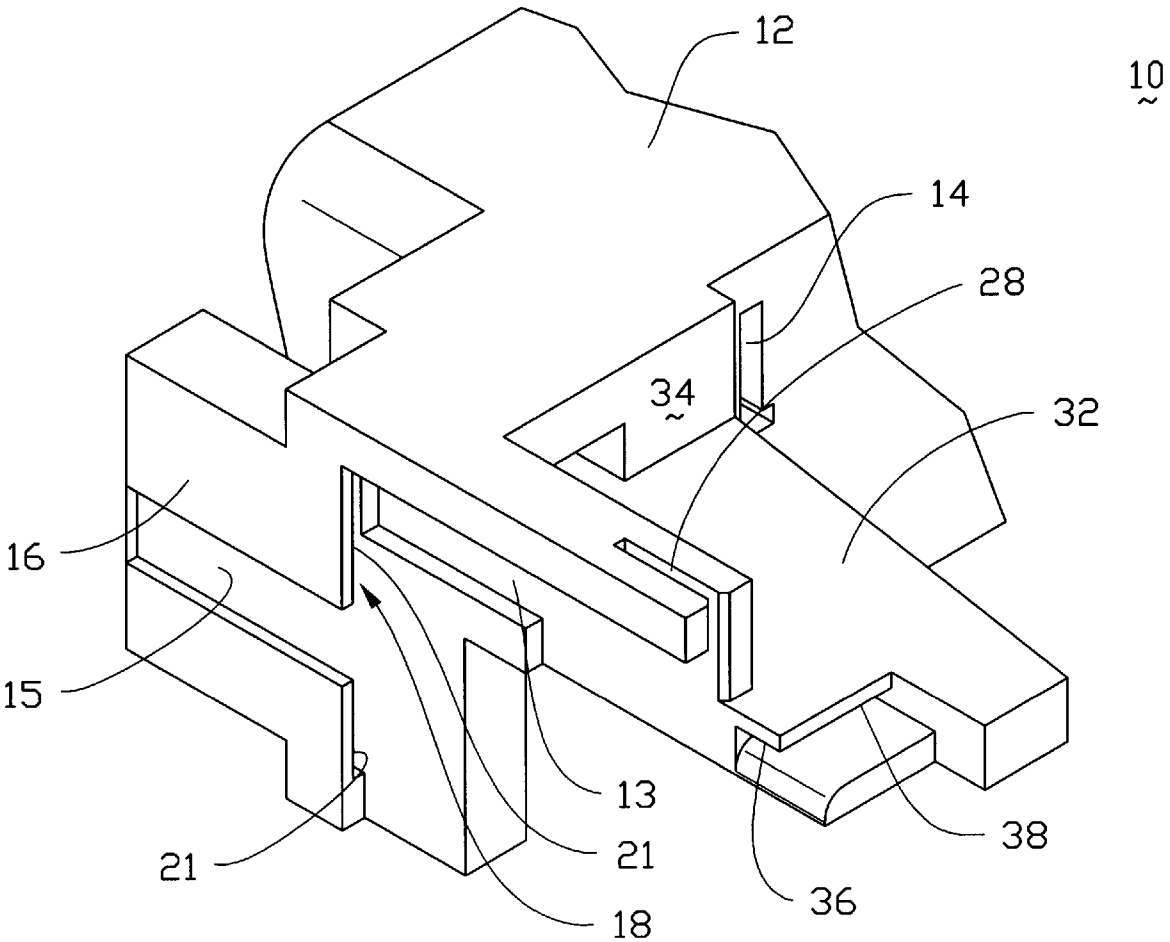
FIG. 4 is a fragmentary rear perspective view of the housing of the connector of FIG. 1.

References will now be in detail to the preferred embodiments of the invention. It will be noted here that for a better understanding, most of like components are designated by like reference numerals throughout the various figures in the embodiments.

Attention is directed to FIGS. 1–4 wherein a horizontal type male electrical connector 10 includes an insulative housing 12 with a plurality of passageways 14 for receiving a corresponding number of contacts (not shown) therein for engagement with contacts of a complementary connector (not shown).

A vertical wall section 16 is positioned at each end of the housing 12 and defines a slot 18 for receiving a corresponding boardlock 20 therein. The boardlock 20 includes a first T-shaped vertical section 22 with barbs 23 formed thereon for retaining the boardlock 20 in the slot 18 and for engaging a corresponding grounding tang of the complementary connector (not shown), and a second T-shaped vertical section 24 with a downward extending leg section 25 for extending through a boardlock hole 102 defined in a PC board 100 on which the connector 10 is mounted. The boardlock 20 further includes an upward extending tab 26 for cooperation within a restriction channel 28 of the housing 12 for efficiently controlling the position of the leg section 25. To comply with the structural dimensional relationship between the boardlock hole 102 in the PC board 100 and the grounding tang of the complementary connector, the first vertical section 22 is not aligned with the second vertical section 24 in a front-to-back direction, due to an offset section 30 being connected therebetween. In this embodiment, the offset section 30 is disposed adjacent to the upper side of the T-shaped vertical section 22.

A horizontal platform 32 extends rearward from a back surface 34 of the housing 12 adjacent to the corresponding vertical wall section 16 at each end. A seating slot 36 is defined in the horizontal platform 32 in communication with a retention cavity 38 (not shown completely) for receiving a corresponding post 40 therein. Each post 40 includes a horizontal section 42 with a barbed tag 44 extending forward for interferential engagement within the retention cavity 38. A vertical lug section 46 integrally extends downward from the outermost end of the horizontal section 42 for extending through a corresponding post hole 104 in the PC board 100. The lug section 46 of the post 40 is substantially aligned with the leg section 25 of the boardlock 20 for complying with the aligned boardlock hole 102 and post hole 104 in the PC board 100.

In assembly, the boardlock 20 is first inserted into the slot 18 and retained therein by the barbs 23 thereof. The tab 26 is adapted to be snugly received within the restriction channel 28 and the leg section 25 extends downward. Successively, the post 40 is inserted into the seating slot 36 with the tag 44 projecting into the associated cavity 38 and retained therein. Accordingly, the boardlock 20 and the post 40 are respectively fixed to the housing 12 and the leg section 25 of the boardlock 20 is aligned with the lug section 46 of the post 40, thereby allowing both the boardlock 20 and the post 40 to be respectively received within the corresponding holes 102, 104 in the PC board 100. In this embodiment, the horizontal platform 32 is positioned around the mid-height position of the housing 12, and is directly seated on the PC board 100, so the board 100 is substantially positioned around the mid-height position with regard to the housing 12.

The slot 18 includes a front section 15 for receiving the first section 22 of the boardlock 20, and a rear section 13 for receiving the second section 24 of the boardlock 20. The front section 15 is offset from the rear section 13 in the front-to-back direction for complying with the configuration of the boardlock 20. The front section 15 is generally of a T-shaped configuration to comply with the basic shape of the first vertical section 22. A pair of shallows 21 are defined therein for receiving side portions 29 on either side of a raised portion 19 of the first vertical section 22. Thus, the boardlock 20 can be reliably and securely retained within the housing 12.

Figure 5:
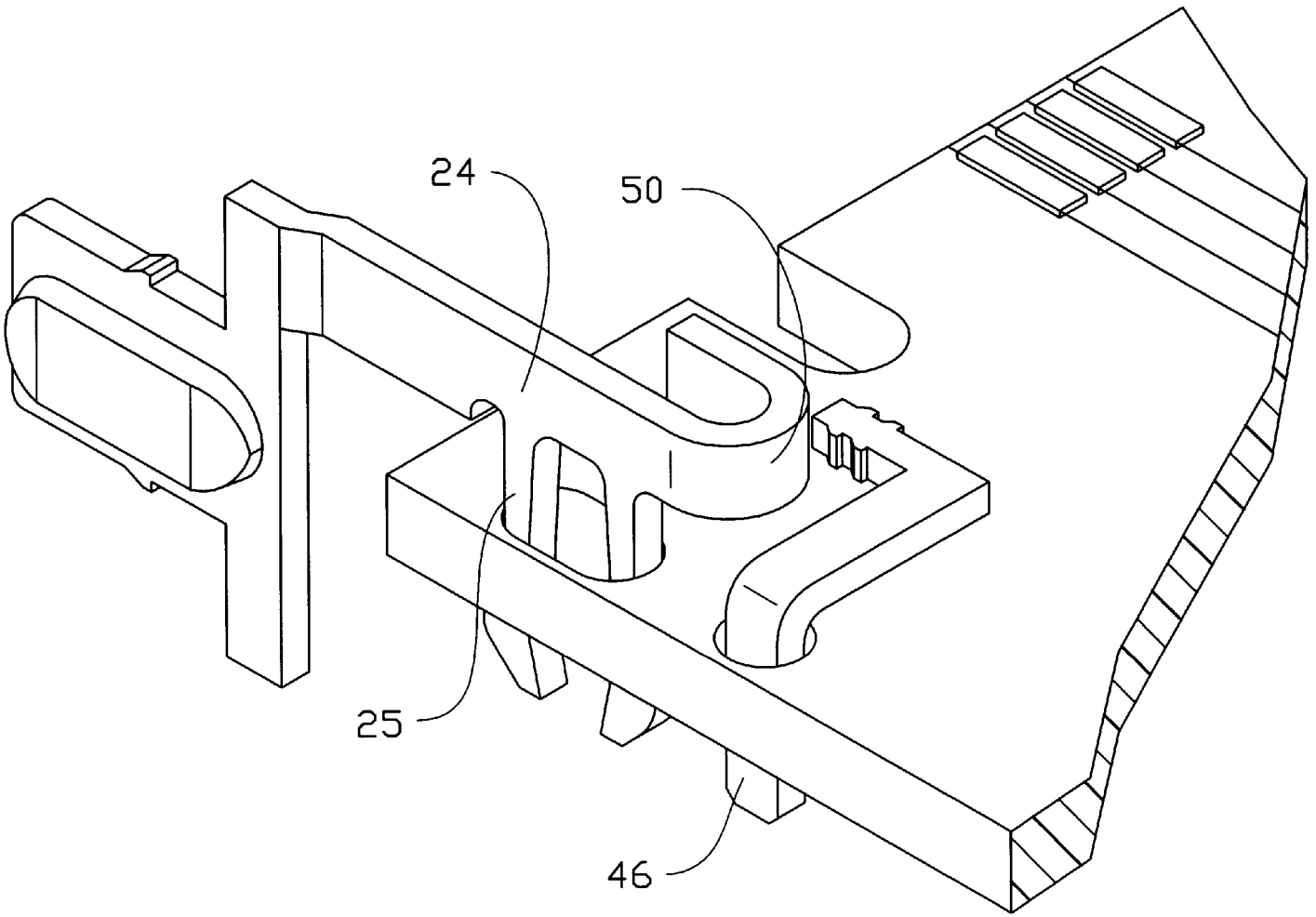
FIG. 5 is a perspective view of another embodiment of the boardlock in accordance with the present invention.
Figure 6:
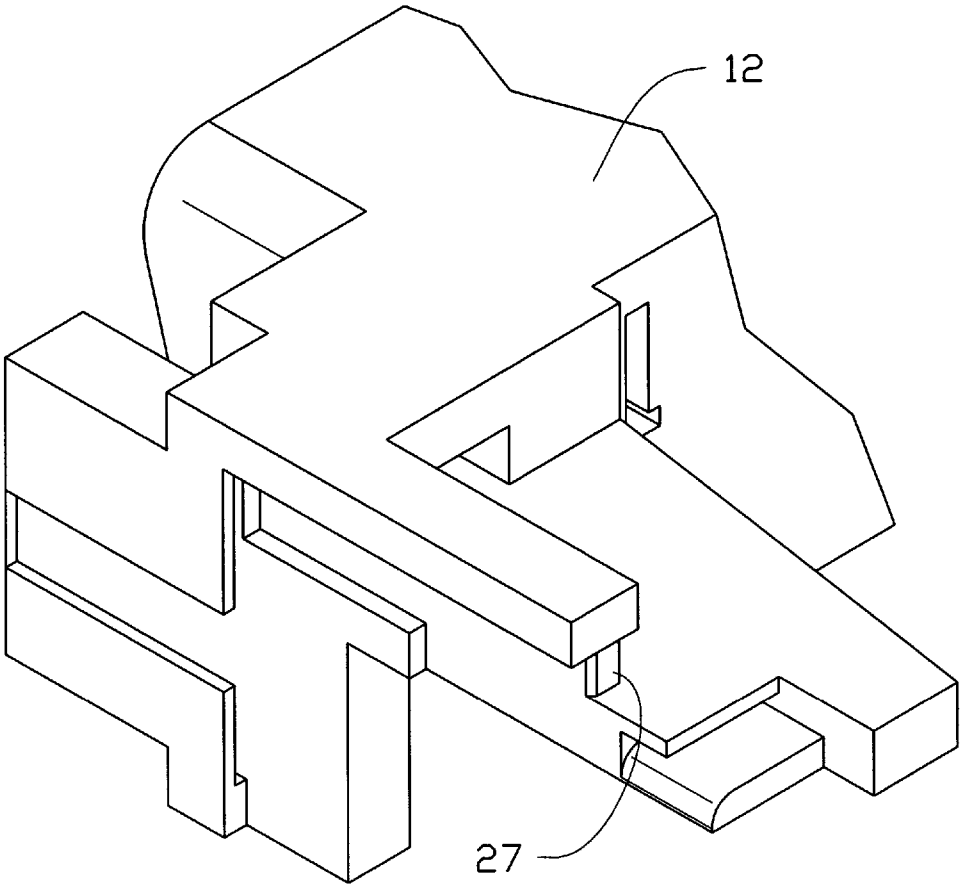
FIG. 6 is a fragmentary rear perspective view of another embodiment of the connector of FIG. 5.
Figure 7:
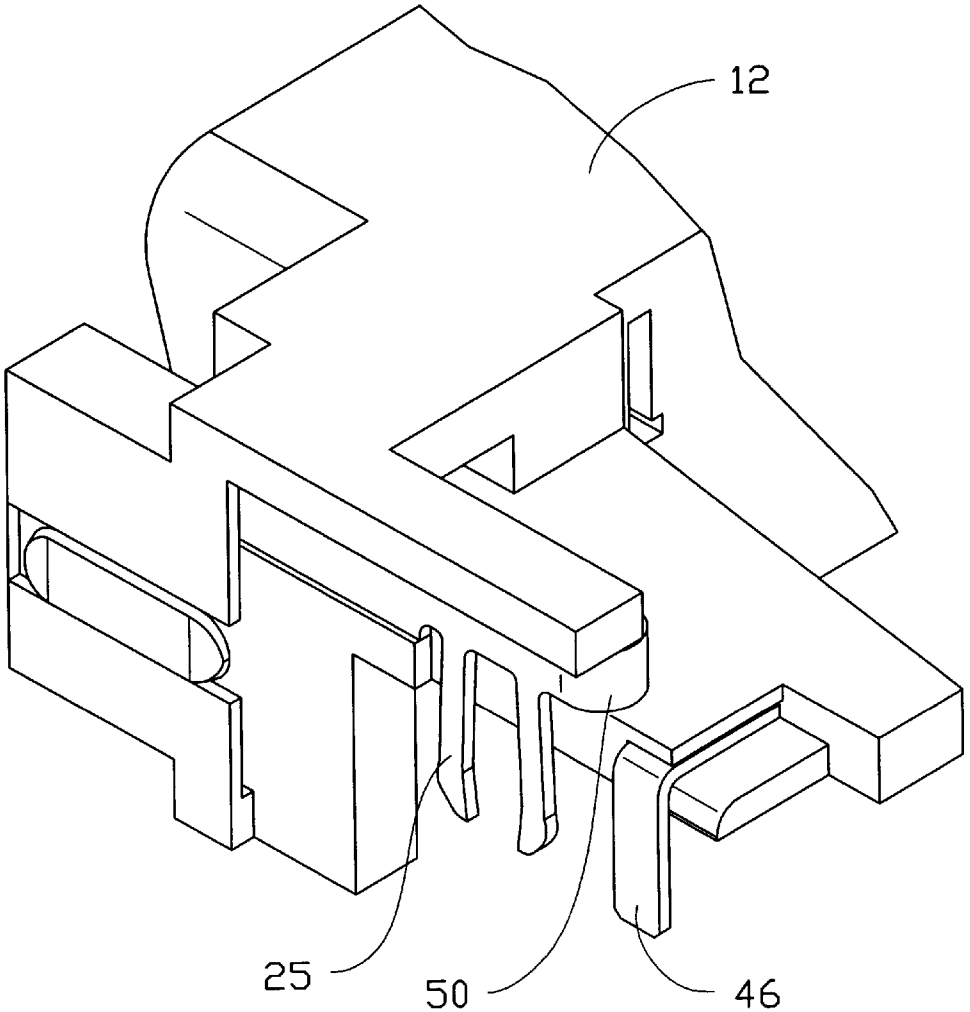
FIG. 7 is a fragmentary rear perspective view of the connector of FIG. 5.

FIGS. 5–7 show another embodiment of the present invention wherein a U-shaped locking section 50 is disposed at the end of the second vertical section 24 to grasp an abutment wall 27 of the housing 12 for efficiently controlling the vertical position of the leg section 25 of the boardlock 20.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A connector including:

an insulative housing receiving a plurality of contacts therein;

a boardlock disposed adjacent to one end of the housing, said boardlock including an engagement section for engagement with a grounding tang of a complementary connector, and a leg section adapted to be received within a corresponding hole in a PC board on which the connector is mounted; and a post including a lug section adapted to be received within a corresponding hole in the PC board; wherein the engagement section and the leg section of the boardlock are offset from each other in a front-to-back direction, and the boardlock and the post are separated from each other while the leg section of the boardlock and the lug section of the post are aligned with each other in said front-to-back direction.

2. A method for assembling a connector having a boardlock and a post, the steps comprising:

providing an insulative housing of the connector with a vertical slot for first insertion of the boardlock therein; and providing the housing with a horizontal slot for successive insertion of the post therein; wherein a leg section of the boardlock is aligned with a lug section of the post in a front-to-back direction so that the leg section of the boardlock and the lug section of the post can be respectively received within a corresponding boardlock hole and a corresponding aligned post hole in a PC board on which the connector is mounted.

3. A connector comprising:

an insulative housing receiving a plurality of contacts therein;

a boardlock disposed adjacent to one end of the housing, said boardlock including at lest a leg section; and a post disposed adjacent to the boardlock, said post including at least one lug section;

wherein the boardlock and the post are not integral with the housing nor with each other, and are adapted to be sequentially inserted into the housing, so that the boardlock is first assembled to the housing, and then the post is successively assembled to the housing, whereby the leg section of the boardlock is aligned with the lug section of the post in a front-to-back direction, each of the leg section and the lug section adapted to be received within a corresponding hole in a PC board on which the connector is mounted.

* * * * *